US005894664A

United States Patent [19]

Bullard et al.

[11] Patent Number: 5,894,664

[45] Date of Patent: Apr. 20, 1999

[54] SEATING SUSPENSION ASSEMBLY FORMATION METHOD

[75] Inventors: Larry I. Bullard; Allen Sigmon, both of High Point; Roger Tornero, Greensboro, all of N.C.

[73] Assignee: Leggett and Platt, Inc., Carthage, Mo.

[21] Appl. No.: 08/916,512

[22] Filed: Aug. 22, 1997

Related U.S. Application Data

[62] Division of application No. 08/693,702, Aug. 7, 1996, Pat. No. 5,700,060.

[51] Int. Cl.[6] ..... B23P 11/00

[52] U.S. Cl. ..... 29/896.92; 29/451

[58] Field of Search ..... 29/451, 896.9, 29/896.92; 267/91, 94, 142, 143, 144, 146; 297/452.63, 452.5, 452.52, 452.53, 452.56, 452.57; 5/186.1, 191, 230, 720

[56] References Cited

U.S. PATENT DOCUMENTS

| | | | |
|---|---|---|---|
| 67,077 | 7/1867 | Smith | 267/91 |
| 371,448 | 10/1887 | Hale . | |
| 3,120,381 | 2/1964 | Sweeney et al. . | |
| 3,462,779 | 8/1969 | Thompson . | |
| 4,229,240 | 10/1980 | Borgiani | 267/143 X |
| 5,149,065 | 9/1992 | Willden et al. | 267/146 X |
| 5,570,874 | 11/1996 | Tornero | 267/95 |

FOREIGN PATENT DOCUMENTS

| | | | |
|---|---|---|---|
| 89426 | 6/1957 | Norway | 297/452.56 |
| 218194 | 7/1924 | United Kingdom | 267/91 |

*Primary Examiner*—S. Thomas Hughes

[57] ABSTRACT

A seating suspension assembly provides efficiency in the manufacture of upholstered furniture such as chairs, sofas or the like. The preferred form of the invention comprises a pair of flexible, durable fabric straps having coil springs fixedly positioned therebetween. The fabric can be attached to a rigid wooden chair seat frame and the suspension assembly stapled or tacked thereto. The coil springs are thus suspended between the front and back of the frame. Upon upholstering, the suspension assembly provides a comfortable, crowned seat for the user. A method of forming the seating suspension assembly is also disclosed.

7 Claims, 4 Drawing Sheets

SEATING SUSPENSION ASSEMBLY FORMATION METHOD

This is a division of application Ser. No. 08/693,702, filed Aug. 7, 1996, now U.S. Pat. No. 5,700,060.

BACKGROUND OF THE INVENTION

1. Field of the Invention

The invention herein pertains to upholstered furniture seating assemblies and particularly to resilient assemblies which are suspended between rigid furniture components such as found on chair or sofa frames.

2. Description of the Prior Art and Objectives of the Invention

Furniture manufacturers have constantly improved their products and manufacturing techniques through the years in an attempt to provide consumers with comfortable, durable and reasonably priced upholstered furniture. Metal coil and sinuous springs have been used for many years in chair and sofa frames to the satisfaction of the purchasers. However, as labor costs have sharply risen, manufacturers are turning to a variety of constructions, some of which utilize fabric straps and webbings in place of the usual metal springs. Certain decking or suspension fabrics have been well accepted whereas others have been either too stiff or too resilient for widespread acceptance. Also, prior spring assemblies for furniture seating of the all metal type are extremely heavy and make handling and shipping difficult and expensive.

Thus, with the disadvantages and problems associated with prior art seating constructions and assemblies, the present invention was conceived and on of its objectives is to provide a seating suspension assembly which w ill provide the user with comfort and durability over a period of years.

It is another objective of the present invention to provide a seating suspension assembly which can be mass-produced in continuous form and delivered to the furniture assembly area in a convenient-to-handle roll.

It is yet another objective of the present invention to provide a seating suspension assembly which can be easily, quickly affixed to a furniture frame by a single worker.

It is still another objective of the present invention to provide a resilient seating suspension assembly and method which may include covered, pretensioned coil springs, fibrous batts or a polymeric foam.

It is also an objective of the present invention to provide a method for forming a suspension assembly utilizing a fabric top strap and a fabric base strap which are joined in parallel alignment to create a pocket therebetween for receiving a coil spring or other resilient member.

It is a further objective of the invention to provide a seating suspension assembly which provides a "crowned" seat.

It is also an objective to provide a seating suspension assembly which has a pre-loaded or tensioned center.

It is another objective of the invention to provide a seating suspension assembly with different tensions along the top, center and bottom.

Still another objective of the invention to provide a suspension assembly which is easy to install by not requiring extreme tensioning on the flexible straps.

Various other objectives and advantages of the present invention will become apparent to those skilled in the art as a more detailed description is set forth below.

SUMMARY OF THE INVENTION

The aforesaid and other objectives are realized by providing a suspension assembly whereby a top strap or web is affixed to a bottom strap to form a opening or pocket therebetween. Resilient members, such as non-tensioned or pretensioned coil springs, a bent wire form, a fibrous batt or a polymeric foam are contained within the pocket just described. The preferred form of the suspension assembly utilizes coil springs which are contained within a flexible fabric covering. The spring covering and springs are positioned within the pocket and are attached thereto by metal clips or the like. The suspension assemblies can be mass-produced and packaged in rolls which can then be delivered to assembly areas within the furniture plant. These rolls can be unwound and cut into individual suspension assemblies and attached by staples or the like by a single worker to the furniture frames. Thereafter, fabric coverings, paddings and decorative fabrics can be placed thereon for supporting seat cushions on chairs, sofas and the like.

DESCRIPTION OF THE PREFERRED EMBODIMENT

Figure 1:
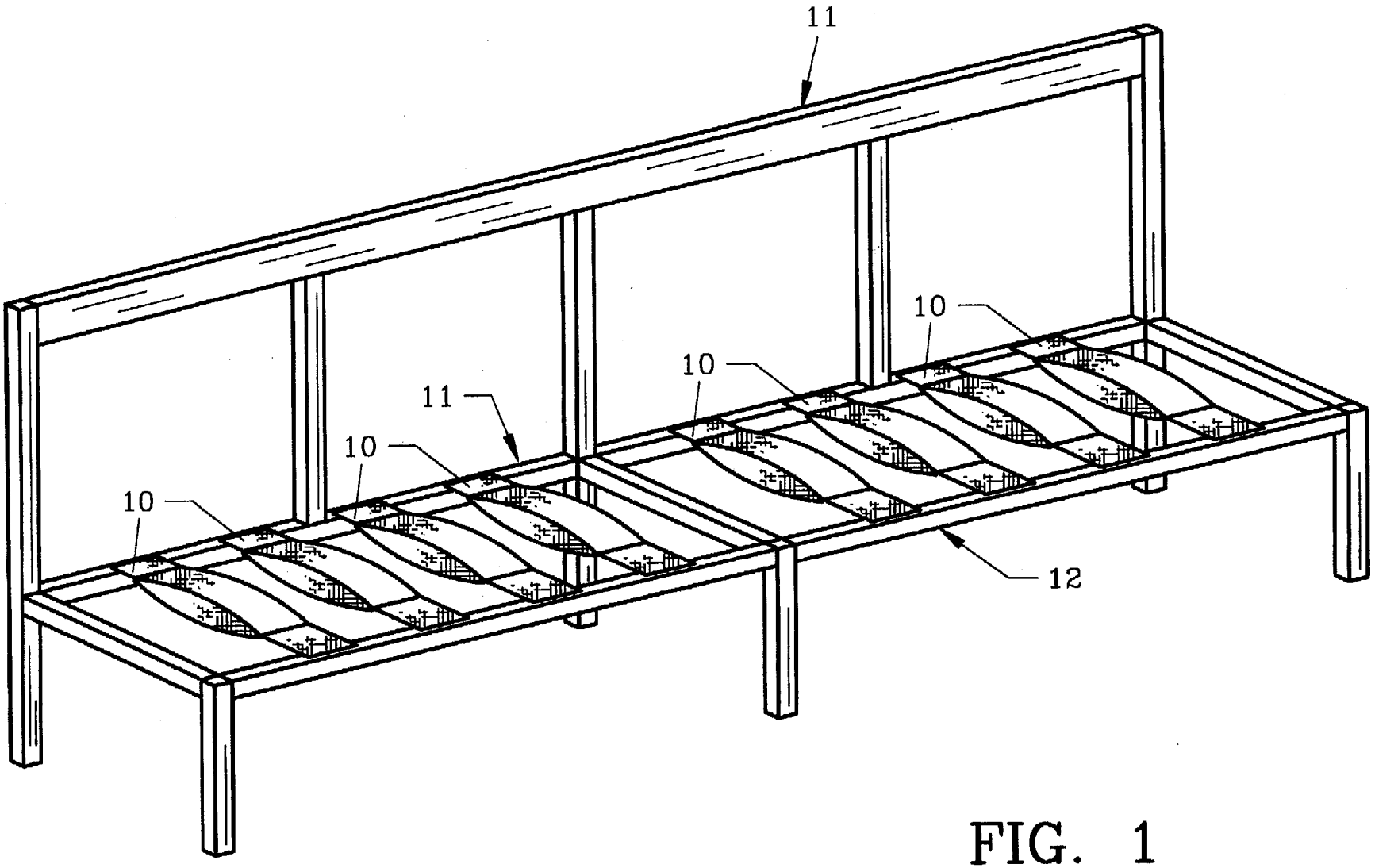
FIG. 1 illustrates a conventional sofa frame with a plurality of suspension assemblies of the invention thereon.
Figure 2:
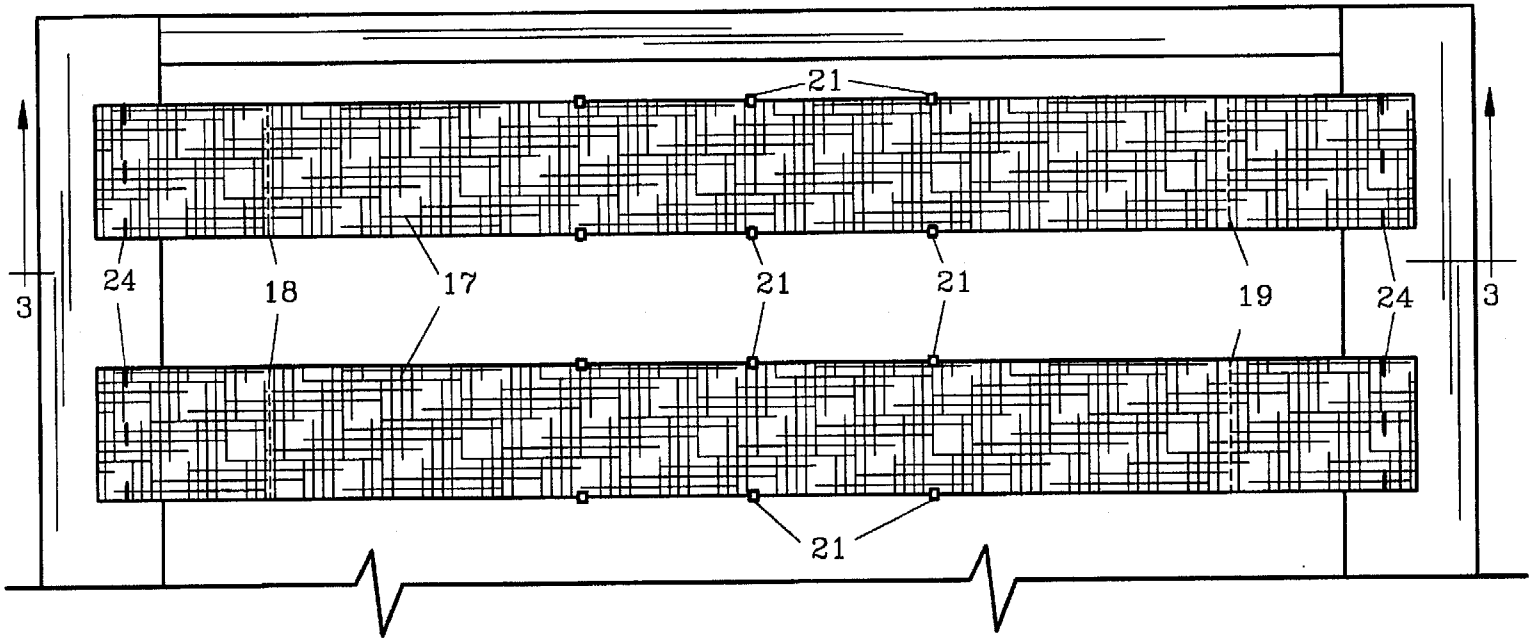
FIG. 2 shows a top view of a section of the seating frame as seen in FIG. 1.
Figure 3:
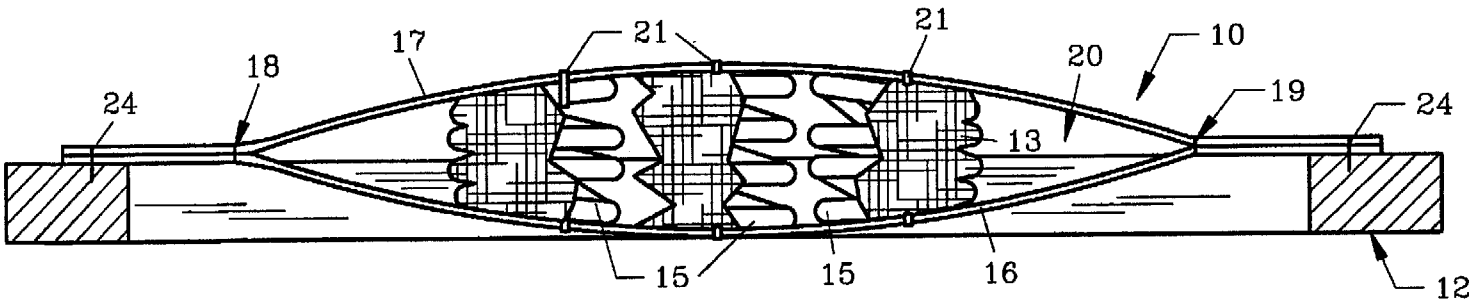
FIG. 3 depicts a cross-sectional view of the seating frame as shown in FIG. 2 along lines 3—3 and with the fabric spring covering partially removed.

The preferred form of the suspension assembly as described herein is shown in FIGS. 1, 2, 3 and 7. As seen in FIG. 3, a plurality of coil springs are pretensioned and enclosed within a fabric covering. The pretensioned springs provide a customized "feel" when sitting, for the user. The suspension assembly includes a top or upper strap member formed from a yarn such as nylon to provide the necessary strength and durability. The upper strap and lower or base strap are attached to each other in parallel alignment such as by sewing whereby a pocket is formed therebetween for reception of the enclosed coil springs. Metal clips are used to maintain the enclosed springs between the upper and lower straps. Other embodiments may use adhesives, C-rings or alternative devices and retention methods.

The preferred method of forming the suspension assembly as described consists of selecting a flexible base strap of desired length such as a nylon strap or webbing having a width of approximately 50 mm. A similar flexible nylon strap is attached to the lower strap in parallel by sewing laterally thereacross at spaced intervals to provide pockets therebetween. Next, pretensioned coil springs which are enclosed within a fabric covering are then inserted between the top and base straps and are affixed therein by the metal clips. The preferred form of manufacturing includes making the suspension members in a continuous roll hereby the suspension members can later be cut into individual assemblies by knives or scissors during furniture assembly.

Detailed Description of the Drawings and Operation of the Invention

For a better understanding of the invention and its operation, turning now to the drawings, FIG. 1 illustrates a typical use of seating suspension assembly 10 as positioned on a conventional wooden sofa frame 11. Sofa frame 11 includes seat frame 12 which is substantially rectangularly-shaped with opposing spaced front and rear components and as seen herein, utilizes eight seating suspension assemblies 10. Staples, tacks adhesives or other means for fastening suspension assemblies 10 may be used as is standard in the trade. As would be understood, sofa frame 11 is but one of many rigid frames that could be utilized with the invention herein and other frames may include chair frames, vehicle seat frames or otherwise. While suspension assembly 10 is shown affixed to seat frame 12, back frames, arm frames or the like, may employ a suspension assembly 10 as needed.

Seating suspension assembly 10, the preferred form, is seen in FIG. 2 with seat frame 12 in a fragmented top plan view and in FIG. 3, seat frame 12 is shown along lines 3—3 of FIG. 2 with portions of spring covering 13 removed to illustrate coil springs 15 contained therein. Suspension assembly 10 includes a flexible base strap 16 and a flexible top strap 17 which is affixed to base strap 16 by stitching 18 and 19. Thus, base strap 16 and top strap 17 form a pocket 20 therebetween for containing resilient coil springs 15. Coil springs 15 are bound or otherwise secures in place within pocket 20 such as by u-shaped metal clips 21, also as further shown, springs 15, which are slightly compressed, are wrapped or enclosed by spring cover 13 formed from a conventional fabric.

A wide variety of fabric straps may be employed for base strap 16 and top strap formed from natural or synthetic fibers such as nylon. In addition, additional resiliency can be added to base strap 16 and top strap 17 by incorporating elastomeric yarns therein as is well-known and commonly employed in the strapping or webbing industries. The exact dimensions and constructions of strap 16, 17 are not described further herein, as such constructions are varied and well-known.

In order to attach suspension assembly 10 to seat frame 12, staples 24 are employed as seen in FIGS. 2 and 3, although tacks, hooks, adhesives and other fasteners may be utilized in particular circumstances, and depending on the seat frame construction metal coil springs 15 (FIG. 3) are pretensioned and held by spring covering 13.

Figure 7:
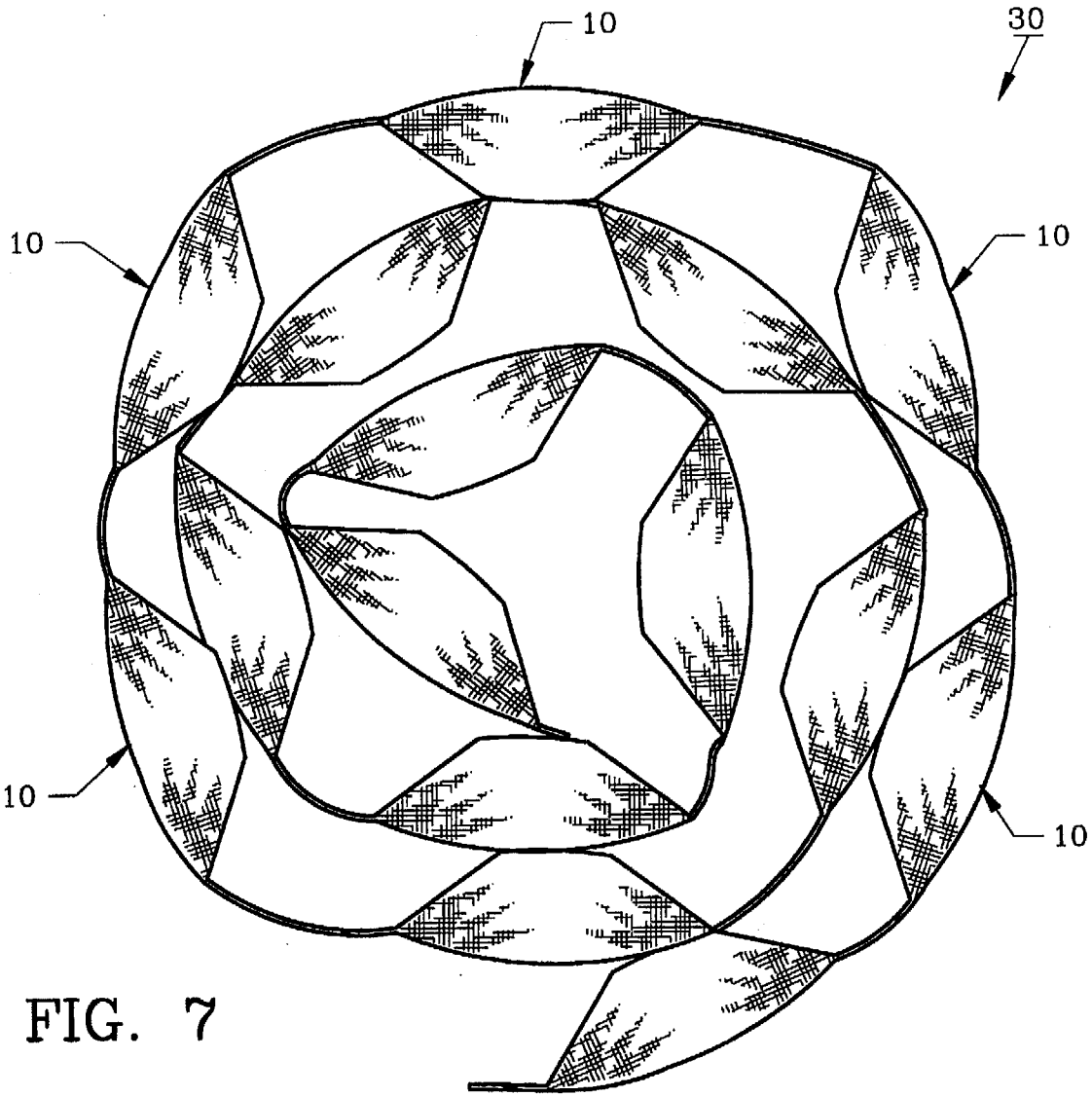
FIG. 7 illustrates a continuous roll of the suspension assemblies as seen in FIG. 3 before separation into individual assemblies.

Suspension assembly 10 can be mass or continuously produced and thereafter wound in rolls 30 as shown in FIG. 7 for shipment to various furniture plants. Rolls 30 could be made in various sizes and lengths, and then unwound, separated and utilized as required during furniture assembly. Rolls 30 could be made in various lengths and diameters for convenience in handling and storage.

Figure 4:
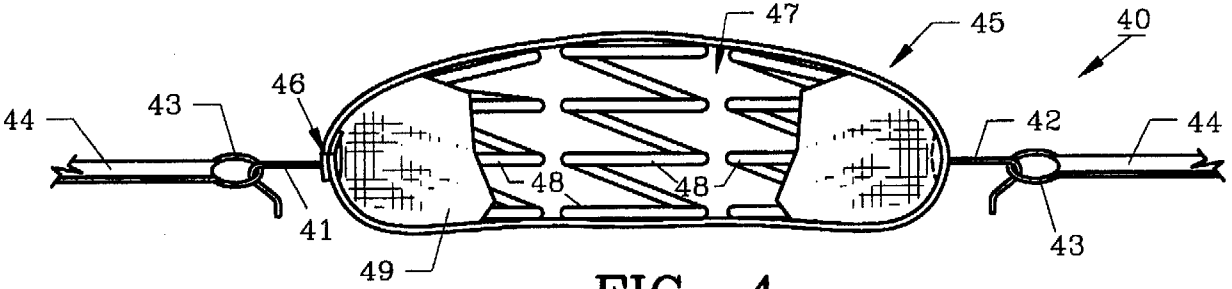
FIG. 4 features another embodiment of the suspension assembly of the invention.

Various other embodiments of seating suspension assemblies could be likewise provides and in FIG. 4, suspension assembly 40 is shown which includes metal hooks 41, 42 for attachment to a loop or catch 43 attached to a conventional furniture frame (not seen) by straps 44, or possible placemen in holes or slots in frames formed of metal tubing. Suspension assembly 40 includes a webbing or strap 45 which may be, for example, 50 mm wide, and sewn together by stitches 46. Webbing 45 forms an internal pocket 47 for containing metal coil springs 48. Springs 48 are pretensioned (slightly compressed) to provide customized comfortable support for the user during sitting. An outer spring cover 49 (shown cut away for illustrative purposes) encloses resilient coil springs 48 within pocket 47. Air or fluid bladders may be used in specialized circumstances in place of the resilient springs.

Figure 5:
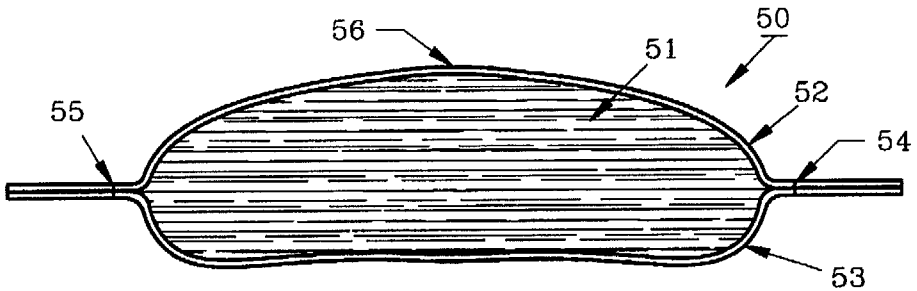
FIG. 5 show yet another embodiment of the suspension assembly of the invention.

Another suspension assembly embodiment is shown in FIG. 5 which is constructed like seating suspension assembly 10, however, rather than containing coil springs, contains a resilient fibrous batt 51 which may consist of polyester, nylon or other suitable non-woven fibers. As seen, assembly 50 is constructed with a top strap or webbing 52 and a bottom strap 53 which are joined together by sewing at each end of suspension assembly 50 by stitching 54, 55. Seating suspension assembly 50 may be, for example, 50 mm wide and have an overall height 100–150 mm at its crown 56.

Figure 6:
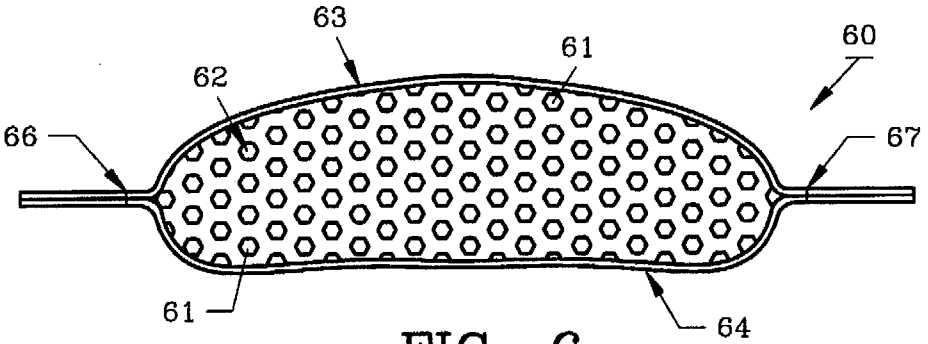
FIG. 6 demonstrates still yet another embodiment of the invention.

In another embodiment, seating suspension assembly 60 in FIG. 6 is formed as is seating assembly 50, however, an open cell polymeric foam of suitable density such as polyurethane foam 61 is placed in pocket 62 between upper flexible strap 63 and lower flexible strap 64. Straps 63, 64 can be sewn together at the ends of suspension assembly 60 by stitching 66, 67. Suspension assembly 60 may be 50–70 mm wide and have a height at its crown of approximately 100–150 mm.

The illustrations and examples provided herein are for explanatory purposes and are not intended to limit the scope of the appended claims.

I claim:

1. A method of forming a suspension assembly for a seat frame comprising:

a) selecting a base strap formed from a flexible fabric, b) selecting a top strap formed from a flexible fabric, c) attaching said top strap to said base strap in parallel alignment at their respective ends to form a pocket therebetween while providing means for attaching said straps to a seat frame, said attaching means oppositely spaced proximate the ends of said top strap, d) selecting a resilient member, and e) securing said resilient member within said pocket.

2. The method of claim 1 further comprising the step of attaching said suspension assembly to a rigid seat frame by stapling said attaching means to said seat frame.

3. The method of claim 1 wherein the step of selecting a resilient member comprises the step of selecting a plurality of resilient members and the step of securing said resilient member within said pocket comprises the step of securing each of said plurality of resilient members within said pocket.

4. The method of claim 3 wherein selecting a plurality of resilient members comprises selecting a plurality of coiled springs.

5. The method of claim 1 wherein selecting a resilient member comprises selecting a coil spring.

6. The method of claim 1 wherein selecting a resilient member comprises selecting a fibrous batt.

7. The method of claim 1 wherein selecting a resilient member comprises selecting a polymeric foam member.

* * * * *